United States Patent [19]

Lauchenauer

[11] Patent Number: 4,778,477

[45] **Date of Patent: * Oct. 18, 1988**

[54] FOAM TREATMENT OF AIR PERMEABLE SUBSTRATES

[75] Inventor: Alfred E. Lauchenauer, Horn, Switzerland

[73] Assignee: Adnovum AG, Switzerland

[ * ] Notice: The portion of the term of this patent subsequent to Aug. 19, 2003 has been disclaimed.

[21] Appl. No.: 824,632

[22] Filed: Jan. 31, 1986

[30] Foreign Application Priority Data

| | | | |
|---|---|---|---|
| Feb. 1, 1985 | [GB] | United Kingdom | 8502644 |
| Apr. 23, 1985 | [GB] | United Kingdom | 8510296 |
| Dec. 13, 1985 | [GB] | United Kingdom | 8530710 |

[51] Int. Cl.[4] ..... B41M 1/10; D06M 1/00; D06M 13/34

[52] U.S. Cl. ..... 8/477; 427/296; 427/350; 427/369; 427/389.9; 8/107; 8/115.6; 8/149.1; 8/505

[58] Field of Search ..... 427/369, 389.9, 296, 427/350; 8/505, 115.6, 477, 149.1, 107; 162/101

[56] References Cited

U.S. PATENT DOCUMENTS

| | | | |
|---|---|---|---|
| 4,118,526 | 10/1978 | Gregorian et al. | 427/350 |
| 4,365,968 | 12/1982 | Gregorian et al. | 427/350 |

*Primary Examiner*—Janyce Bell

*Attorney, Agent, or Firm*—Ostrolenk, Faber, Gerb & Soffen

[57] ABSTRACT

This invention relates to the application of a treatment agent to an air permeable substrate by forming a foam of a liquid containing or constituting the treatment agent and applying the foam to the substrate and causing or allowing the foam to transit the substrate and to be removed from the other side thereof in which process the foam is applied in an excess defined as a ratio of the foam transit liquid content of the material in which case the amount of treatment agent taken up by the substrate will be dependent solely on the concentration of the agent within the foam and not by the volume of the foam applied and further the amount of agent taken up by the substrate is substantially independent of the initial water or liquid content of the substrate.

15 Claims, 1 Drawing Sheet

FOAM TREATMENT OF AIR PERMEABLE SUBSTRATES

This invention relates to the foam treatment of fibrous materials, textile and non woven substrates and matts.

The treatment of fibrous materials and substrates frequently involves the incorporation of a specific amount of a treatment agent such, for example, as a dye or a catalyst, per unit area of substrate treated. The amount of any given agent to be applied will depend very much on the circumstances, the nature of the fibre substrate, and the final effect desired. Hitherto, any kind of substrate treatment requiring the precise addition of a given amount of an agent has required very careful control over the process conditions and of the physical application of the agent itself. Frequently, although not always, agents are added in the form of an aqueous solution, and application may be for example by spraying, padding or dipping of the substrate.

In each case, the control of the "add-on" of the agent in solution and hence the agent carried therein, is essential, and control systems to obtain uniformity of dyeing, or application of treatment and finishing agents has been the subject of an increasing amount of technological effort.

It has been proposed to treat fibrous substrates with a treatment bath in the form of a foam. European Pat. No. 0047058, for example, describes and claims a method of treating the surface of a substrate with an agent, which method comprises establishing said agent(s) in a liquid phase, forming a foam of said liquid phase, applying said foam to the surface to be treated to establish the foam layer on the surface and causing the foam to collapse progressively to deposit agent on said surface characterised in that the collapse of the foam takes place at the foam surface interface without vacuum and subsequently the supply of reagent is terminated by removing the foam layers, thereby terminating the decomposition of the foam at the interface. In this case, the agent may be present as an aqueous solution. The essence of this invention is one of control, in this case of the decomposition at the substrate/foam interface; while the control may be exercised more easily in such a foam application, control is still necessary in order to ensure that a uniform and precise add-on of agent is obtained.

An essential feature, therefore, of all treatment processes for fabrics in order to have a controlled add-on, has been (i) control of the concentration of the bath, and (ii) control of the period or amount of treatment or of the amount of the bath applied and taken up by the material.

The control of the bath concentration of active agent to be applied is relatively easy, but control of the amount of constituent added per unit surface area of the substrate to be treated is more difficult; thus dipping, squeezing, spraying or by the application of foam have always relied on the basis that the amount of active ingredient plus liquid carrier added, is carefully controlled and applied in a uniform manner over the entire surface of the substrate to be treated, so that the final amount of active ingredient included within the fibrous material is known.

My copending PCT application No. EP83/00292 describes and claims a process for treating an air permeable sheet material which process comprises applying to one side of an air permeable sheet material foam containing an agent capable of lowering the surface tension of said foam liquid; causing the foam to permeate the interstices of the sheet material by the application of a pressure gradient thereacross; and removing foam liquid from the other side of said sheet material.

Such a process has been found to have a strong dewatering effect on wet sheet material. Hitherto, it has always been considered that if one were to apply a treatment chemical or agent to one side of the material and withdraw quantities from the other as proposed in my published specification numbered as above, then control of the process would be lost.

The above application teaches both a treatment process and a dewatering process for a fibrous material. For a typical substrate material, if the material is totally dry, then the application of this process of PCT application No. 83/00292 will result in a precise add-on of treatment agent irrespective of the amount of treatment liquid applied.

The above numbered PCT application discloses that by applying a foam to a material such that the foam permeates the interstices of the substrate material and so that foam is withdrawn from the side remote from the side of application, a dewatering effect is obtained such that after treatment the water or liquid content of the treated substrate will always be of substantially the same order. The weight of liquid remaining in the substrate after treatment measured per unit dry weight of substrate treated will always be substantially the same irrespective of whether the fabric material was dry or wet to start with.

It thus follows that in such a treatment process, starting with a dry material the amount of take-up of foamed liquid can be determined by a simple experiment at the on-set and the concentration of treatment agent within the liquid which is subsequently foamed to effect the treatment can be controlled to obtain the desired add-on per unit weight, volume or area of the substrate to be treated. The amount of add-on will be totally independent of the amount of foam applied and in consequence, one of the precise areas of control necessary hitherto is removed from consideration.

In order to obtain such precision, however, according to the above numbered PCT application, material to be treated must be totally dry and there must be no residual water or liquid present within the material to be treated. The presence of amounts of liquids within the substrate prior to treatment would appear to result in loss of control of the amount of additional add-on to be obtained by such a foam treatment.

In general, water or liquid is retained in fibrous materials in two ways. There is water that is absorbed which is bonded or otherwise retained within the structure of the fibres. This absorbed water normally produces swelling of the fibres and the "percentage swellability" or the percentage of swelling, i.e. the actual amount of swelling over the total amount of swelling of which the material is capable, is a measure of the amount of absorbed water contained therein.

The second way in which water is incorporated in a fibrous substrate or fibrous material is by way of adsorbed water. In this case, the water is simply retained by addition to the surface of the fibres and is retained loosely in the fibrous structure. Adsorbed water is relatively easily removed and by traditional methods has been removed by, for example, physical methods such as centrifuging which will removed the adsorbed water and yet leave the absorbed water retained within the fibrous structure.

By performing the dewatering operation of the PCT application No. EP83/00292, the adsorbed water is readily removed and the absorbed water is "topped up" to the maximum permitted.

A man skilled in the art, therefore, will conclude that even with a proportion of absorbed water present, the treatment process of PCT application No. EP83/00292 can be employed to provide predictable add-on using the foam treatment process and that by simply measuring the amount of absorbed water currently within the material it will be possible to deduce the amount that could be taken up by further treatment and from that, by the application and suitable adjustment of the concentration of treatment agent within the liquid to be foamed, and then apply the foam treatment of application No. EP83/00292, the desired add-on of treatment agent can be obtained.

However, the present applicant's has found that this does not work.

It has been found that by providing an excess of foam containing a treatment agent, any adsorbed water is removed, as would be expected in accordance with the teaching of PCT application No. 83/00292, but also, an add-on of treatment agent occurs which is substantially independent of the initial water content of the fibrous substrate.

According to the present invention, therefore, there is provided a process for the application of a treatment agent to an air permeable substrate which method comprises, (i) forming a liquid bath comprising said treatment agent, (ii) forming a foam from said liquid bath, (iii) applying said foam to a first side of said substrate, (iv) causing said foam to permeate the interstices of said substrate by the application of a pressure gradient thereacross, (v) and removing foam liquid from a second side of said substrate, characterised in that (a) the foam is applied in an excess defined as a ratio of the foam transit liquid content of the sheet material as herein defined, and determined with reference to (i) the foam transit liquid content of said substrate and, (ii) the initial liquid content of the substrate prior to treatment with the foamed liquid bath, and in that (b) the amount of agent taken up by the substrate is dependent on the concentration of the agent in the foamed liquid bath and not by the volume of the liquid bath applied in foam form, whereby the amount of agent taken up by said substrate is substantially independent of the initial water content of the substrate.

For the purposes of this specification, the take-up of foam liquid by the dry fibrous substrate will hereinafter be referred to as "the foam transit liquid content", i.e. the amount of foam liquid retained in the substrate after a foam has been passed therethrough under conditions such that foam is removed as such from the side of the substrate remote from that to which the foam is applied.

Thus, given the known take-up of the foam liquid by the dry fibrous substrate, the desired concentration of reagent can be determined for add-on to the substrate material.

Thus, a reagent bath may be prepared with the desired concentration of treatment agent therein and the resulting reagent bath is then foamed and the treatment applied in the manner of PCT application No. 83/00292 subject always to the fact that the desired minimum excess of foam is present. In one embodiment of the invention, the excess to be applied is determined by the formula:

$$e_{min} = \frac{5(y + 20)}{(x - y + 50)} \qquad \text{Formula A}$$

in which x is the foam transit liquid content as defined above and y is the initial water content of the substrate prior to commencement of the treatment.

The figure $e_{min}$ is a ratio which defines the minimum excess of the foam liquid which needs to be applied to the substrate over and above that which will be taken up by the substrate when the foam has been applied to dry substrate material to determine the initial take-up of the foam liquid, i.e. the foam transit liquid content. Thus, if a sample of the substrate is dried initially to remove all absorbed water and is then treated with a sample of the foam to be used in the treatment, a quantity (by weight or volume as the case may be) of the foam taken up by the initially dry substrate will be the datum amount. The value of e obtained by Formula A above, is the multiplicand to be applied to the said datum amount of foam to determine the minimum amount of foam to constitute an excess over and above said datum amount which may be applied to the substrate in order to obtain the desired add-on of treatment agent irrespective of the amount of water initially present in the substrate. The minimum excess 'e' may be expressed in terms of a percentage of the foam transit liquid content.

It will be appreciated that from the minimum excess of formula A given above, the more water present in the fabric material prior to the onset of the foam treatment, the greater the amount of the minimum excess of foam required to effect the required add-on of treatment agent. Even when there is both adsorbed and absorbed water present, i.e. the initial water content of the fabric is greater than the final liquid content of the fabric after the foam treatment, the degree of add-on of treatment agent remains substantially constant for a given foam composition substrate system provided a sufficient excess of foam is added.

In a typical substrate treatment, therefore, it will be appreciated that the following initial work will be necessary before a treatment run takes place:

1. The water or the foam transit liquid content of the fabric substrate must be determined to provide constituent x, of formula A above.

2. The water content of the fabric prior to treatment must also be determined as a percentage of the dry weight of the fabric. This will provide constituent y of the formula referred to above.

In order to define the "datum" for calculating the physical amount of foam liquid constituting a minimum excess in accordance with Formula A above, it will be necessary to prepare a sample of foamed liquid and to determine the proportion of take-up of the foam as a percentage of the dry substrate weight; this will provide the datum amount for calculating the excess of foam required for treatment of the substrate.

Thus in general it is more convenient to take "x" in formula A as the foam transit liquid content of the dry fabric (the foam liquid absorption) rather than the water retentive property of the substrate. Where the water retentive property i.e. swellability is known, this may be employed instead of the foam transit liquid content, thus saving step 1 of the initial work referred to above.

In general, the water retentive property of the substrate is less than the foam transit liquid content thus reducing the denominator of formula A above. This has the effect of increasing the minimum foam excess e by a small amount, but since 'e' is a minimum, the excess so calculated is within the invention.

The minimum excess will then be determined by multiplying the datum amount of liquid content by weight or volume of foam, by the figure $e^{min}$ calculated from formula A above and this will give the amount of foam per unit area to be applied either in terms of volume of a given foam or terms of weight of foam liquid to be applied irrespective of the properties of the foam.

Where the substrate contains both absorbed and adsorbed water prior to treatment, the value of y as a maximum may be taken as equal to x in the said formula.

The foam ratio for the treatment bath may be any acceptable foam ratio specified within PCT application No. 83/00292 referred to above, the disclosure of which is hereby incorporated into this specification by reference.

In conducting the treatment in accordance with the present application and as described in PCT application No. 83/00292, the essential feature of the invention is that the foam should pass as foam from one side of the substrate to the other. Although the above numbered PCT application No. 83/00292 discloses that the foam should permeate the interstices of the sheet material, it should be noted as long as the bubbles of the foam extend up to the second face of the sheet material to be treated, it is not necessary that the foam liquid should be removed as foam from the second side thereof although, of course, this is desirable in many applications. The limiting factor of the invention is that where foam liquid is withdrawn from the second side of the substrate being treated, as foam liquid, in which case the bubbles of the foam as applied extend right the way through and up to the interface defining the second face of the substrate and the surroundings.

The process of this invention may be applied to dyes, bleaching agents, finishing agents in general to be incorporated in fibrous sheet materials, more particularly air permeable fibrous sheet materials.

The invention is also particularly useful, for example in the removal and/or inactivation of undesirable products in textile sheet material after finishing. Thus, formaldehyde and crosslinking catalysts in cellulose-containing textile sheet material may be removed or rendered inactive readily after the crosslinking treatment of the fabrics.

The invention is applicable to any air permeable fibrous or non fibrous substrate. The substrate may be, for example, a textile sheet material, a non-woven matt, such as a paper. The invention may be applied to particulate substrates such as slurries or sludges.

The liquid bath is typically a solution of a treatment agent in a liquid and is usually an aqueous solution. However, the invention is applicable to dispersions of a treatment agent in a carrier liquid, for example, a dispersion of a pigment dye in water. Such a dispersion may be a colloidal dispersion or solution of the treatment agent in a carrier liquid, or may be a dispersion of finely divided particles of a treatment agent in a carrier liquid.

In another embodiment of the present invention, the foamed treatment bath may be applied between two layers of a substrate to be treated. The two layers may then be squeezed between a pair of rollers to provide a pressure gradient to cause or allow the foam to pass through each substrate to debouch from each of the outer surfaces of the "sandwich" so formed.

In a further aspect of the invention multiple layers of substrate material may be treated simultaneously, the amount of foam being adjusted accordingly.

The accompanying drawings illustrate aspects of the invention described above.

In the drawings:

FIG. 1 shows the take-up of treatment agent (as ordinate) for a given substrate by a given treatment bath when plotted against the initial water content of the substrate (as abscissa).

Line A shows the amount of take-up of treatment agent for samples of substrate of varying initial water content, by applying the liquid bath in the form of a foam in accordance with the present invention.

Line B shows the amount of take up of treatment agent for similar samples of the same substrate where the treatment agent has been applied to the substrate as a liquid bath, unfoamed.

It will be seen that the take up or add on using the foam provides a consistant and substantially uniform take up of treatment agent for each sample for a given foam and that this take up is substantially independent of (a) the initial water content of the sample, (b) the amount of foam applied, provided a minimum excess of foam is used.

With the liquid application, the take up of treatment agent was patchy and the amount of agent taken up fell off with increased initial water content of the sample.

Figure 1:
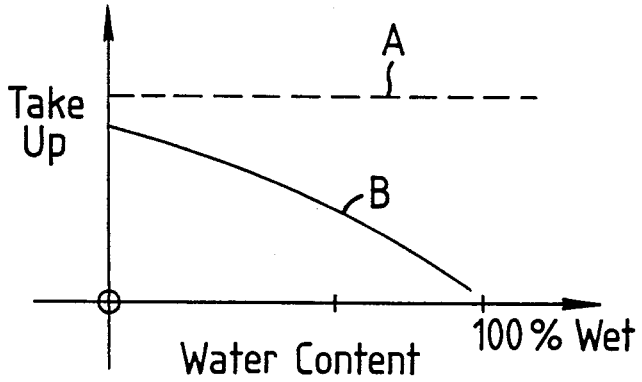
FIG. 1 is a graph showing the relative take up performance of a liquid treatment and a foam treatment.
Figure 2:
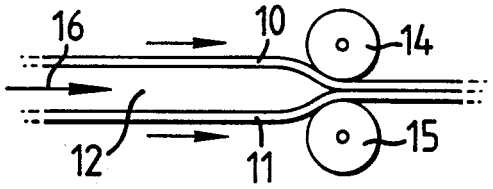
FIG. 2 is a diagrammatic representation of the simultaneous application of foam to two layers of substrate.

Turning now to FIG. 2, a pair of substrate sheets 10 and 11 are passed towards a pair of rolls 14 and 15 which are adjusted to squeeze substrates 10 and 11 together. The substrates are spaced apart at 12 before passing rolls 14 and 15 and a foamed treatment bath is injected at 16 into space 12 so that as substrates 10 and 11 are squeezed together by rolls 14 and 15. A pressure gradient is generated which urges the foam through the substrates to debouch as foam from the outer surface thereof.

Following is a description by way of example only of a series of experiments which demonstrate the principle of the present invention.

EXAMPLE 1

A cotton broad cloth having a weight of 118 grams per square centimeter was used as a test fabric. The water retention of this material was determined by treating 1 gram with about 100 mls of distilled water containing 1 gram per liter of a non-ionic wetting agent. The material had been conditioned at 20° C. at 65% relative humidity for at least 2 hours before wetting.

The cotton broad cloth material was immersed in the water for 8 hours and thereafter the material was removed from the beaker and lightly pressed by hand and transferred into a filter tube. The tube was inserted in a centifuge as described in Swiss Standard Reference No. 198592 at a speed of 2800 to 3000 rpm. The sample was removed from the tube and its weight was determined immediately afterwards. The difference between the weight of the wetted and centrifuged sample and the dry weight of the cloth was determined as the water retention of the material, factor x in formula A above. The cotton broad cloth of this example was found by this method to have a water retention of 44%.

A treatment bath of 300 grams per liter of dimethylol-(dihydroxy ethylene urea) containing 62.3% of solids was prepared and the resulting bath was foamed using a blow ratio of 55:1. Various samples of the cotton broad cloth were then provided with different water contents as set out below and a foam treatment was conducted by the method described in the PCT Application numbered as above. Foam was applied to one side of the sample and was drawn through under a partial vacuum so that foam debouched from the side of the fabric remote from the side of application.

The results are set out in Table 1 below.

It will be noted that in each case, the liquid content of fabric after treatment lay within a relatively narrow band.

The actual excess "e" of foam expressed as a ratio of the percentage liquid content in test A1 and A2 is set out in the column "Actual Excess e (Ratio)" and the physical thickness of the foam that was passed through in millimeters is set out along side to show the relationship between the thickness of the foam on the one hand and the actual excess e as calculated. It will be seen that where the excess is of the order of or greater than the minimum excess calculated by the formula A, substantially consistant add-on of reagent is obtained, whereas where the excess applied for example, in E1 and D1, falls substantially below the minimum excess calculated by formula A above, then a much lower proportion of add-on results.

TABLE 1

| Trial No | Test | Water content before treatment (% owf) | Water content after treatment (% owf) | Dry Add-On (after Drying) (% owf) | Foam layer (mm) | Excess of Bath (1) | Minim. Excess Calcul. |
|---|---|---|---|---|---|---|---|
| 50 | A1 | 0 | 51.6 | 11.8 | 5 | 75% | 105% |
| 51 | A2 | 0 | 45.0 | 9.9 | 13 | 354% | 105% |
| 52 | B1 | 11.7 | 44.9 | 7.2 | 5 | 75% | 90% |
| 53 | B2 | 10.5 | 45.3 | 10.8 | 13 | 354% | 80% |
| 54 | C1 | 14.7 | 51.8 | 11.4 | 5 | 75% | 118% |
| 55 | C2 | 18.2 | 45.9 | 9.1 | 13 | 354% | 156% |
| 56 | D1 | 36.2 | 46.5 | 9.0 | 5 | 75% | 475% |
| 57 | D2 | 32.5 | 46.2 | 10.4 | 13 | 354% | 475% |
| 58 | D3 | 28.0 | 44.9 | 10.4 | 19 | 663% | 475% |
| 76 | E1 | 45.0 | 44.2 | 8.9 | 5 | 75% | 650% |
| 77 | E2 | 46.1 | 43.7 | 9.7 | 13 | 354% | |
| 78 | E3 | 45 | 38.8 | 9.0 | 26 | 775% | |
| 79 | E4 | 46.9 | 42.5 | 10.0 | 42 | 1370% | |
| 59 | F1 | 66.1 | 47.2 | 6.2 | 5 | 75% | 650% |
| 60 | F2 | 63.4 | 48.2 | 9.1 | 13 | 354% | |
| 61 | F4 | 71.6 | 46.6 | 10.8 | 26 | 775% | |
| 62 | F5 | 68.4 | 48.6 | 11.9 | 42 | 1370% | |

*calculated for a wet add-on of 45%
(1) amount of liquid in foam over and above the foam transit liquid content.

EXAMPLE 2

This is a control experiment to demonstrate the much lower dry add-on obtained if the unfoamed treatment formulation (i.e. as a liquid) is sucked through a fabric (the broadcloth of Example 1 above) instead of a foamed bath, or even if the same fabric is immersed for a long time in the unfoamed bath. The results are set out in Table 2 below.

In Tests 63 and 63A, the liquid (unfoamed) bath containing 300 g/l of DMDHEU and 2 g/l Sandozin N/T was sucked the broadcloth which contained 43 to 44% of water. Even though the water content (i.e. the wet add-on) was considerably higher after the treatment (54 and 55% instead around 45%), the dry add-on was substantially lower than for the foamed bath (6.0–6.4% instead of 9 to 11%) and Test 64, the fabric containing 45% water was immersed in a large excess of the treatment bath for 4 hours, then spun. Test 65 followed the same procedure as Test 64, but was immersed for 24 hours.

TABLE 2

Foam Transit Application (FTA): Cotton Broad Cloth
Comparison between FTA and Liquid Transit Application (LTA)
Fabric: Cotton broad cloth, 110 g/sq.m, bleached
Bath: 300 g/l DMDHEU (62.3% solids)

| Test No | Test Design. | Water content at time of treatment (owf) | Water content after treatment owf | Dry add-on owf | Excess (1) | Degree of Add-on (1) |
|---|---|---|---|---|---|---|
| 63 | $EL_2$ | 43% | 54%* | 6.4% | 90% | 53% |
| 63A | $EL_2$ | 44% | 55%* | 6.0% | 900% | 55% |
| 64 | Imm 4 h | 45% | 35%** | 6.0% | (immersed 4 hours) | 76% |
| 65 | Imm 24 h | 42% | 37%** | 6.2% | (immersed 24 hours) | 75% |

*after liquid bath was sucked through
**after spinning
(1) based on solids content obtained in foam application trials with dry fabric (10.1% owf of solid add-on at 45% wet add-on), calculated for a 45% wet add-on

EXAMPLE 3

A cotton fabric (broad cloth, 0.15 cm thick, 110 grams/$m^2$, desized, scoured, bleached, mercerised, vat dyed) was treated with a foamed bath containing:

120 g/l dimethylol-(dihydroxyethylene urea) (DMDHEU), (50% solids content)
15 g/l magnesium chloride hexa-hydrate,
30 g/l polyethylene softener,
4 g/l nonionic foaming agent.

The targeted add-on of DMDHEU was 2% on the weight of the cloth.

The water content of the fabric before the treatment was 3%; the water retention (as measured by the method described in Example 1) was 45%.

The fabric was passed horizontally at a speed of 60 meters/minute thourhg an applicator comprising a knife-type foam applicator for applying foam to the upside of the fabric in a predeterminable thickness and a vacuum slot arranged a very short distance downstream to cause the foam applied to the surface to transit rapidly through the fabric.

The bath was foamed in a rotary foamer to a blow ratio of 20:1 before being applied to the fabric. It had a half-life {determined by letting it stand at room temperature (22° C.) in a graduated cylinder beaker} of 40 minutes.

The volume of foam transiting through the fabric was equal to an amount of bath 2.5 times the water retention of the fabric i.e. an excess of 150%, the foam transit rate was 4 cubic centimeters per square centimeter per minute. The final wet add-on was 45% owf. After the application treatment, the fabric was dried on a tenter frame. Crosslinking of the DMDHEU was effected by heating to 160° C. for 2.5 minutes.

The add-on of DMDHEU was 1.9 to 2.1% owf. The experiment was repeated and the add-on was virtually the same when the blow ratio of the foam was increased to 50:1, or when the excess of liquid transiting through the fabric in foamed form was doubled to 5 times or reduced to 2 times.

EXAMPLE 4

The fabric described in Example 3 was treated with the same foamed bath, but in wet state, i.e. without the intermediate drying after it had been washed after dyeing to remove unfixed dyestuff.

The water content of the fabric was 65% owf.

The foamed bath was recycled, i.e. the excess debouching from the underside of the fabric was used again in the same way, the blow ratio being kept at about the original level by passage through a static foamer when necessary.

The treatment of the fabric was carried out in different ways:

4(a) The treatment of the fabric was carried out as described in Example 3, the foamed bath, applied in an excess of 20 times the water retention value (x=45%, y=45%+; the minimum excess according to formula A is 6.5 and was not increased beyond this value because y is higher than x). The foam thus acted both as dewatering and treating agent. To make this excess of foamed bath transit through the fabric, foam was applied and sucked through in three steps (three foam applicators/-vacuum slot devices arranged in line).

The liquid content of the fabric after the treatment was 45% owf, the add-on of the agent after drying and curing was within +10% of the add-on observed in Example 3.

This treatment required the addition of a booster during recycling of the foam, i.e. the addition of a concentrated bath to restore the bath concentration diluted by the removal of residual water from the fabric.

4(b) The fabric was pre-dried on drying cans before the treatment to a water content of about 25%. It was then treated as described in Example 3, except that the excess of foamed bath was 5 times greater than the water retention value (x=58, y=25 minimum excess 3.21), i.e. a layer of about 5 mm of foam with a blow ratio of 20:1 was applied to the fabric. The liquid content of the fabric after the treatment was 45% owf, the solids add-on after drying and curing was substantially the same as in Example 3.

4(c) The wet fabric was dewatered according to the process described in copending PCT Application No. EP83/00292 by sucking a foam of a blow ratio of 35:1 (produced by foaming water containing 2 g/liter of a nonionic foaming agent) through the fabric. The water content after the dewatering treatment was 45% owf.

The fabric thus freed of excess water (excess over water retention value) was then treated as described in (4a) above, the liquid add-on after the treatment and the solids add-on after drying/curing was the same as that obtained in Example (4a).

EXAMPLE 5

The treatment of Example 1, trials E1 to E4 inclusive was repeated with the same fabric, except that three layers of fabric were treated simultaneously Treating conditions and results obtained were virtually unchanged from those of Example 2, the volume of foamed bath etc., being of course adjusted to the triple weight of fabric treated. The dry weight add-on of the test samples was substantially identical with the results set out in Table 1 E3.

EXAMPLE 6

Example 1 was repeated for samples of tissue paper having a weight of 40 grm per square meter. In this case the aqueous treatment bath was a wet strength enhancing bath comprising:

| | |
|---|---|
| Knittex TC Powder (77% Solids) | 200 gm/lt. |
| Sandozin NT | 2 gm/lt. |

The bath was foamed at a blow ratio of 35:1 and was applied to a single layer of tissue paper as set out in Example 1. The results are as shown in Table 3 below.

It should be noted that in Trial 1, Test A1: wet add-on 115%, dry add-on and in Trial 2, Test A2: wet add-on 124%, dry add-on average of wet add-on 120%. Average of dry add-on for Trials 1 and 2 adjusted to 120% wet add-on 18.5% dry add-on at 120% wet-add-on.

TABLE 3

| Trial No | Test | Water content before treatment (% owf) | Water content after treatment (% owf) | Dry Add-On (after Drying) (% owf) | Foam layer (mm) | Excess of Bath (%) |
|---|---|---|---|---|---|---|
| 1 | A1 | 0 | 115 | 18.8 | 5 | 150 |
| 2 | A2 | 0 | 124 | 18.0 | 13 | 520 |
| 3 | B1 | 11.4 | 121 | 20.4 | 5 | 150 |

TABLE 3-continued

| Trial No | Test | Water content before treatment (% owf) | Water content after treatment (% owf) | Dry Add-On (after Drying) (% owf) | Foam layer (mm) | Excess of Bath (%) |
|---|---|---|---|---|---|---|
| 4 | B2 | 11.1 | 118 | 20.3 | 13 | 520 |
| 5 | C1 | 19.6 | 116 | 21.5 | 5 | 150 |
| 6 | C2 | 19.5 | 115 | 19.5 | 13 | 520 |
| 7 | D1 | 42.5 | 126 | 20.3 | 5 | 150 |
| 8 | D2 | 27.0 | 119 | 18.9 | 13 | 520 |
| 9 | D3 | 27.9 | 114 | 21.0 | 19 | 840 |
| 10 | E1 | | | | 5 | |
| 11 | E2 | 46.4 | 117 | 21.8 | 13 | 520 |
| 12 | E3 | 49.1 | 118 | 22.6 | 26 | 1150 |
| 13 | E4 | 53.1 | 110 | 20.0 | 42 | 1900 |
| 14 | F1 | 72.4 | 113 | 19.7 | 5 | 150 |
| 15 | F2 | 72.7 | 117 | 20.7 | 13 | 520 |
| 16 | F3 | 72.0 | 117 | 24.0 | 26 | 1150 |
| 17 | F4 | 76.9 | 117 | 20.5 | 42 | 1900 |

EXAMPLE 7

In the next series of tests, two types of dyestuff formulations were sucked through the broadcloth used in previous tests in foamed and unfoamed form, the fabric being dry in one set of tests and wet in another.

Tests 66, 67, 68, 68a and 69 were carried out with a bath containing:

3 g/liter of Helizarin Blue RLW 100 g/liter of Helizarin Binder FA 2 g/liter of Sandozin NT.

Tests 72, 73, 74, 74a and 75 were carried out with a bath containing 3 g/liter of Alizarin Brillian Blue RLW 2 g/liter of Sandozin NT.

Helizarin Blue is a pigment dyestuff, Alizarin Brilliant Blue an acidic dyestuff (generally used for dyeing fibres containing amine or amide groups) with virtually no affinity to cellulose.

The results are set out in Table 4 below.

TABLE 4

| Test No. | | Swelling test water retention 44% Water content when Treated | Application | Water content after treatment |
|---|---|---|---|---|
| 66 | 72 | 0% | foam sucked through, excess 15% | 45% |
| 67 | 73 | 44% (swell. power) | same, excess 230% | 45% |
| 68 | 74 | 0% | unfoamed, liquid equal to (67) | about 58% |
| 68a | 74a | 0% | unfoamed, liquid twice as much as in 67/73 | about 60% |
| 69 | 75 | 44% | unfoamed, liquid volume excess 230% (as 67/73) | 58% |
| 70 | 76 | 44% | immersed in bath (50:1) for 4 hours | 57% |
| 71 | 77 | | as 70/76, but for 24 hours | 61% |

66/72 Foamed bath sucked through fabric, fabric dry

67/73 in Tests 66/72, containing about 45% water in Tests 67/73. Residual bath content about equal to swelling test water content (44–45%).

68/74 Liquid (unfoamed) bath (identical to foamed bath used in Tests 66/72 and 67/73) sucked through. In Tests 68a/74a, the volume was doubled since the volume of bath equal to the volume used in foamed form (Tests 66/72) was insufficient for wetting of the dye material uniformly.

Important: The bath content of the fabric after the treatment with unfoamed bath was about 30% higher than for foam transit Tests 66/72 and 67/73, i.e. liquid-treatment samples contained about 30% more bath.

From the results set out in Table 4, it will be noted:

1. Tests 66 and 67 gave about the same depth of shade. Tests 72 and 73 also gave about the depth of shade. This means that irrespective of the initial water content of the fabric, the application of the foamed dyebath produced virtually the same depth of shade.
2. Tests 68 and 74 (unfoamed dye both equal in amount to the volume applied in foamed form in Tests 66 and 72 sucked through dry fabric) gave shades about equal to those obtained in Tests 66 and 72. It was difficult to compare the depth of shade because it provided difficult to produce uniform distribution of the small amount of liquid over the entire area of the dry fabric.
3. Tests 68a and 74a (unfoamed dye bath double in volume than that of Tests 66, 67, 72 and 73) applied to dry fabric by sucking through naturally gave a substantially deeper shade than previous tests, the residual volume of dye bath left on the fabric being almost 30% higher than in the case of application in foamed form.
4. Tests 69 and 75, (unfoamed dyebath double in volume of the dyebath applied in foamed form in Tests 66/67 and 72/73, applied to fabric containing 44% of water by sucking through wet fabric), however, gave shades substantially lighter not only than the shade of Tests 68a and 74a, but even much lighter than those of Tests 66/67 and 72/73. This means that even twice the amount of unfoamed dyebath had produced a dye add-on considerably lower than that achieved by sucking through the wet fabric as foam.

EXAMPLE 8

In another set of dyeing experiments, depths of shade were rated for broadcloth samples treated with foamed and unfoamed dyebaths applied by sucking through in dry and wet state, single and multiple layer configurations.

Dyebaths used

Tests 14D to 23:

3 g/liter Sirius light scarlet BN 10 g/liter Nace
2 g/liter $Na_2CO_3$
2 g/liter Sandozin NT Tests 1 to 8:

3 g/liter of Alizarin Brilliant Blue RLW (Bayer) 2 g/liter Sandozin NT conc.

Sirius light scalet has good affinity to cotton, the Alizarin dyestuff substantially none.

| Test | No. | Water content of foam fabric when treated | Application |
|---|---|---|---|
| 14 | 1 | 44% | foam |
| 16 | — | 44% | liquid |
| 17 | — | 0% | foam |
| 18 | — | 0% | liquid |
| 20–22 | 3–5 | 44% | foam, 3 layers |
| | 6–8 | 44% | foam, 3 layers |

Results

1. Sample 16 showed a lighter shade than Sample 14, i.e. less substitution had taken place.
2. Sample 17 showed about the same depth of shade as Sample 14, i.e. practically the same depths were obtained with foam.
3. Sample 18 had a slightly higher shade than Samples 17, but a slightly deeper shade than Sample 16.

Tests 20–22 and 3–5 plus 6–8 were multiple layer applications, where foamed dyebath was sucked through three layers of fabric, the purpose of those tests being to show that in all three layers dye add-on to the fabric was about the same.

4. In the Samples 20–22 and 3–5 as well as 6–8, only slight if any differences in shade between the samples treated in superimposed configuration could be found (there was some staining due to foam collapse visible on some top layers, so the back sides of the Sample were rated).

I claim:

1. A process for the application of a treatment agent to an air permeable substrate which method comprises, (i) forming a liquid bath comprising said treatment agent, (ii) forming a foam from said liquid bath, (iii) applying said foam to a first side of said substrate, (iv) causing said foam to permeate the interstices of said substrate by the application of a pressure gradient thereacross, (v) and removing foam liquid from a second side of said substrate, characterised in that the foam is applied in an excess of the foam transit liquid content of the sheet material such that the amount of agent taken up by the substrate is dependent on the concentration of the agent in the foamed liquid bath and not by the volume of the liquid bath applied in foam form, whereby the amount of agent taken up by said substrate is substantially independent of the initial water content of the substrate, wherein the treatment agent is selected from the group consisting of dyes, bleaching agents and finishing agents to be incorporated in the sheet material.

2. A process as claimed in claim 1 characterised in that the substrate is an air permeable fibrous or non fibrous substrate.

3. A process as claimed in claim 2 characterised in that the substrate is a textile sheet material or non woven fibrous substrate or matt.

4. A process as claimed in claim 1 characterised in that the substrate is paper.

5. A process as claimed in claim 1 characterised in that foam liquid is removed as liquid from the second side of said substrate.

6. A process as claimed in claim 1 wherein the foam liquid is removed from the said second side of the substrate as foam.

7. A process as claimed in claim 1 characterised in that the excess to be applied is determined by the formula $$e_{min} = \frac{5(y + 20)}{(x - y + 50)} \qquad \text{Formula A}$$

in which x is the foam transit liquid content and y is at least $e_{min}$ the initial liquid content of the substrate prior to commencement of the treatment.

8. A process as claimed in claim 1 characterised in that the liquid bath comprises a dispersion of a treatment agent in a carrier liquid.

9. A process as claimed in claim 8 characterised in that the liquid bath comprises a colloidal dispersion of a treatment agent in a carrier liquid.

10. A process as claimed in claim 8 characterised in that the liquid bath comprises a dispersion of finely divided particles of a treatment agent in a carrier liquid.

11. A process as claimed in claim 1 characterised in that the liquid bath is a solution of the treatment agent in a liquid.

12. A process as claimed in claim 11 charcterised in that the bath liquid is water.

13. A process as claimed in claim 1 wherein the foam is in the form of an aqueous foam having a blow ratio greater than 10:1.

14. A process as claimed in claim 13 characterised in that the maximum cell size of the foam is not more than a quarter of the thickness of the sheet material to which it is to be applied.

15. A process as claimed in claim 1 characterised in that a foam flow constraining substrate is in juxtaposition with the substrate material to support the same during the foam treatment.

* * * * *